US005377614A

United States Patent [19]

Glazer

[11] Patent Number: 5,377,614

[45] Date of Patent: Jan. 3, 1995

[54] REMINDER DEVICE FOR PILL CONTAINERS

[76] Inventor: Bradley M. Glazer, 24835 Penshurst Dr., Beachwood, Ohio 44122

[21] Appl. No.: 973,184

[22] Filed: Nov. 9, 1992

[51] Int. Cl.[6] ..... G09F 11/04

[52] U.S. Cl. ..... 116/308; 116/309; 116/311; 116/312; 116/316; 116/318

[58] Field of Search ..... 40/113, 495; 116/306, 116/308, 309, 311, 312, 315, 316, 318

[56] References Cited

U.S. PATENT DOCUMENTS

| | | | |
|---|---|---|---|
| 332,208 | 12/1885 | Noel | 116/308 |
| 398,012 | 2/1889 | Weaver | 116/308 |
| 868,470 | 10/1907 | Orgain | 116/312 |
| 1,425,456 | 8/1922 | Dial | 116/308 X |
| 1,500,407 | 7/1924 | McLavey | 40/495 X |
| 1,515,122 | 11/1924 | Keys | 40/495 |
| 3,151,599 | 10/1964 | Livingston | 116/121 |
| 3,227,127 | 1/1966 | Gayle | 116/121 |
| 3,903,837 | 9/1975 | Barton et al. | 116/315 |
| 4,011,829 | 3/1977 | Wachsmann | 116/121 |
| 4,419,016 | 12/1983 | Zoltan | 368/10 |
| 4,666,051 | 5/1987 | Trick | 215/230 |
| 4,749,093 | 6/1988 | Trick | 215/220 |
| 4,753,189 | 6/1988 | Mastman | 116/308 |
| 4,782,966 | 11/1988 | Thackrey | 215/230 |
| 4,911,327 | 3/1990 | Shepherd et al. | 221/3 |
| 4,971,221 | 11/1990 | Urquhart et al. | 221/2 |
| 5,029,726 | 7/1991 | Penhill | 221/69 |
| 5,109,984 | 5/1992 | Romick | 206/531 |

FOREIGN PATENT DOCUMENTS

| | | | |
|---|---|---|---|
| 0454912 | 3/1949 | Canada | 116/318 |
| 2536649 | 4/1976 | Germany | 116/318 |
| 0497794 | 9/1954 | Italy | 116/318 |

*Primary Examiner*—William A. Cuchlinski, Jr.
*Assistant Examiner*—W. Morris Worth
*Attorney, Agent, or Firm*—Oldham, Oldham & Wilson Co.

[57] ABSTRACT

A reminder device with circular dials similar to the face of a clock for pill and medicine containers is adapted for attaching to a pill bottle or other container. The rotatable dials may be manually set to indicators showing the weekday, date and time for taking a pill or other medicinal dose. The reminder device is disposable and may be pinned to the bottle top or other medicine container or temporarily affixed by means of an adhesive.

11 Claims, 2 Drawing Sheets

REMINDER DEVICE FOR PILL CONTAINERS

FIELD OF THE INVENTION

This invention pertains to a disposable indicator for attachment to pill or medicine bottles, dispensers, and the like, and more particularly, the invention is a dosage timer and reminder device to assist a user in complying with the proper dosage of a prescribed medication.

BACKGROUND OF THE INVENTION

In general, the optimum effectiveness for most prescribed medicines is achieved by attaining a certain therapeutic range medically determined to be most beneficial to the patient. An excessive level or overdose of medication might be toxic. And underutilization of a medicine might jeopardize the patient's course of treatment and recovery. In the latter case, with less than a therapeutic dose, the patient may endure side effects but have no potential for benefits from the drug due to an insufficient quantity of the medication.

The criticality of a patient's compliance with a prescribed dosage of medication cannot be overstated. Yet, patients frequently forget whether they have taken medication either omitting doses or repeating them.

The problem is accentuated for the elderly who may suffer from several ailments requiring numerous drugs, each having different directions and dosages. Fading memories and confusion often experienced by golden agers compound the problem. In many cases, elderly persons could be independent and self-sufficient, but for their inability to follow a prescribed routine of taking medications.

As the number of elderly people increases and with the use of newer, more potent and sophisticated drugs, the practicality of a timing device for pill or medicine containers is apparent.

Efforts to solve this general problem of non-compliance have resulted in a considerable number of "reminder" caps and pill-timing devices. Compartmentalized containers for holding and providing scheduled dosages of pills have been disclosed in U.S. Pat. No. 4,911,327 to Shepherd, U.S. Pat. No. 4,971,221 to Urquhart, U.S. Pat. No. 5,029,726 to Pendill, and U.S. Pat. No. 5,109,984 to Romick. The foregoing patents may be perceived as somewhat overly complex by their inclusion of electronic reminder means or mechanical dispensing means. The higher cost of these devices is also a negative factor. Compartmentalized devices represent an alternative, though partial solution to the problem, but the drawback is the requirement for a responsible person with the time and patience to fill the compartments properly.

Several additional patents indicates status of the prior art pertinent to pill bottle timer caps as follows.

U.S. Pat. No. 3,151,599 to Livingston has a counter means for indicating sequence of covering and uncovering the lid. U.S. Pat. No. 3,227,127 to Gayle rotates a time dial by relative movement between cover and base. U.S. Pat. No. 4,011,829 to Wacksmann has a counting screw cap with lost motion drive. U.S. Pat. No. 4,419,016 to Zoltan uses a separate element or the counter element may be part of the top and sets an alarm, including a time keeping means, which is the key to opening of the cap. U.S. Pat. No. 4,666,051 to Trick has a series of indicators visible through a viewing window and a locking element operative when the top is rotated in a clockwise direction. U.S. Pat. No. 4,749,093 represents an improvement on the foregoing patent by O. Lee Trick. U.S. Pat. No. 4,753,189 to Mastman has numerical indicia movable with the cap as the cap rotates relative to the bottle, and U.S. Pat. No. 4,782,966 to Thackery allows pressing the container top down for activating the indicators and suggests facility of manufacture of the device.

The foregoing patents, however, disclose devices which are integral to the bottle cap itself, whereby the pharmaceutical manufacturer or others who package pharmaceuticals confront the expense for constructing or purchasing bottle caps incorporating the timing features.

BRIEF SUMMARY OF THE INVENTION

Therefore, there is found a need for a practical, inexpensive and disposable timer device to serve as a reminder for those required to imbibe dosages, in accordance with certain directions on time and quantity thereof.

It is an object of the present invention to provide a reminder device with clock dials for an existing bottle cap and for setting to a specific time by a physician, pharmacist, medical attendant or the user, as a reminder of the dose taken and when to take the next dose.

A further object of the invention is the inexpensive manufacture of the reminder device clock from paper, plastic, or other lightweight materials, whereby the device may be disposed of after a first use but, in the alternative, can be interchanged to a second medicine container by reattachment to the second container.

Yet another object of the invention is the provision of an adhesive tab on a base portion for attaching, or reattachment of, the reminder device to the top or sides of a conventional prescription medicine container.

Still another objective is to provide indicators on dials of the device which can be read or felt to remind the user and ensure compliance with a medicinal dosage prescription.

These and other objects of the invention are accomplished by means of providing a reminder device for pill dispensing containers having a body formed as a thin disk or compressed cylinder. The body includes a base having first and second surfaces, the base having at least one or more apertures therethrough; and, the top portion of the body having one or more apertures corresponding to those of the base. The corresponding apertures of both base and top portions of the body are adapted to receive one or more pins or spindles. A single spindle or a plurality of spindles project outward, essentially orthogonal from the first surface of the base, to the top portion of the body.

The second surface of the base includes a means for adhering the second surface to a surface of an object which, in the preferred embodiment, is an adhesive to attach, remove or reattach the device to a pill bottle or other medicine container.

A dial or plurality of dials are rotatably mounted on at least one spindle. Each of the dials has a perimeter with a means for engaging the perimeter of each dial mounted on the base. The means for engaging retains each dial in a set position after the user rotates the dial relative to said base for the purpose of setting the dial.

The base preferably has a circular shape with a circumference. Each dial, also preferably having circular shape, includes gear teeth on the perimeter and indicia formed on each dial for indicating days of a week, date, and time of day. The means for engaging comprises prongs mounted on the first surface of said base, and the prongs positioned in ratcheting engagement with gear teeth on the perimeter of each dial.

Each of a plurality of dials may be positioned on the base of the reminder device such that a point on the perimeter of a dial corresponds with the circumference of the disk shaped base or, in the alternative, the perimeter of a dial may be completely within the circumference of the base. Recessed areas on the top portion of the body allow the appropriate indicators, i.e., the setting on each dial, to be seen by the user. Finally, another embodiment may include positioning each dial, so that the perimeter of the dial or plurality of dials extends beyond the circumference of the base.

In another embodiment, attachment of the reminder device to a pill bottle top may be accomplished by including in the spindles a sharpened point adapted to extend through the base and then to pierce a pill dispensing container top and to secure the reminder clock to the bottle top.

BRIEF DESCRIPTION OF THE DRAWINGS

Other objects and advantages of this invention will be made apparent in the disclosure of the accompanying specification and drawing, in which.

DETAILED DESCRIPTION OF THE PREFERRED EMBODIMENT

Figure 1:
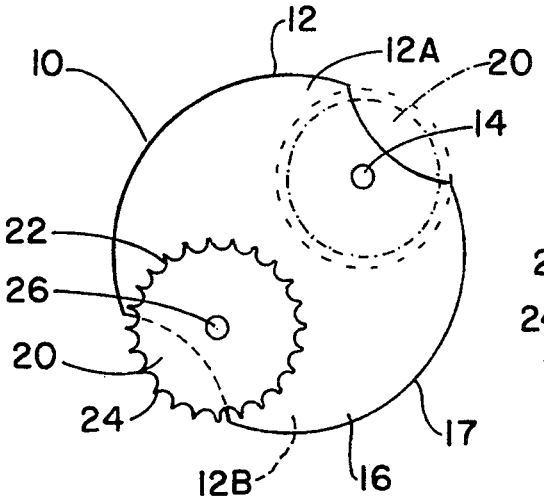
FIG. 1 is a plan view of the base with indicator dials on the inside of the disk-shaped body of the reminder device.

Past timing devices for pill dispensers concentrated on relieving the user from imbibing less than or more than the required dose. Some former dispensers were actuated by removal of the pill cap, however, if the user forgot to notice when the last pill was taken or neglected to take a pill once the pill cap was open or if the device was not set properly or the device malfunctioned, this would result in some discrepancy in the required pharmaceutical dosage.

In reality, the user must in some way interact with the reminder device to know when the next dose should be taken or for assistance in remembering exactly when the last pill or medical dose was imbibed. This invention is directed toward a user friendly pill dispenser allowing a user to focus attention on the periodicity of the medicine dispensation routine, thus acting as a reminder to help keep track of daily dosage of medicine imbibed and daily doses required.

Thus the device of this invention either allows the user to know when he took the last pill or set the device to indicate the time of taking the next dose thereby freeing the user from concentrating solely on the prescribed medical dosage during the course of the day. The timing device is also a reminder not to imbibe too much medicine or overdose due to lack of control. The user must insure quality control by setting the mechanism himself thus acknowledging the user's own responsibility in taking a correct dosage in the proper frequency. If a medicine dispenser malfunctions, or becomes inoperative, the manufacturer would be responsible if this caused the patient to miss or take a wrong dosage thus causing some harm. In the case of the medicine timing device illustrated here, the patient has the obligation for setting the time and thus the responsibility for insuring its correctness which would somewhat relieve the manufacturer from responsibility therefor.

Reference to FIG. 1–FIG. 3C indicates the reminder device 10 of the invention includes a base 12 having a first surface 12A and a second surface 12B, constructed such that the first surface has at least one aperture 14 through the base 12 to receive a pin or spindle 26 which when inserted in the aperture 14 to extend outward from the first surface 12A, essentially orthogonal to that first surface 12A of the base 12, and each spindle extending into corresponding apertures in the top portion 13 of the body. The second surface 12B of base 12 includes a means for adhering the second surface to the surface of another pill bottle (not shown), a pill bottle cap 100 or other medical dispensing container and that means for adhering, is in the preferred embodiment, an adhesive which would allow removal of the reminder device 10 and attachment thereof for a second time on another bottle or container and reuse thereof.

The reminder device may have one or more rotatable dials 20, similar to the face of a clock, and the dials are preferably circular in shape and having a perimeter 22 containing gear teeth 24. Each dial 20 is rotatably mounted on a spindle 26.

Figure 2:
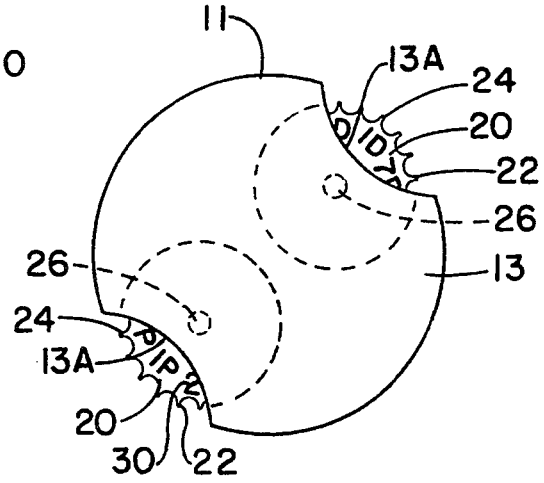
FIG. 2 is a top plan view of a first embodiment of the reminder device.

Furthermore, in the preferred embodiment, the base 12 is formed as a circular disk 16, having a circumference 17, and the preferred embodiment as indicated in FIG. 2 is constructed such that at least one point on the perimeter 22 of the dials 20 coincides with the circumference 17 of the disk-shaped base 12. Indicators 30 are formed on the dials 20 and top portion 13 of the body 11. And in this embodiment, recessed areas 13A are formed on the top portion of the body 11 to serve as windows to the dials 20, so that indicators 30 on dials 20 may be seen; or if there are braille indicators, they may be contacted and read.

Figure 3A:
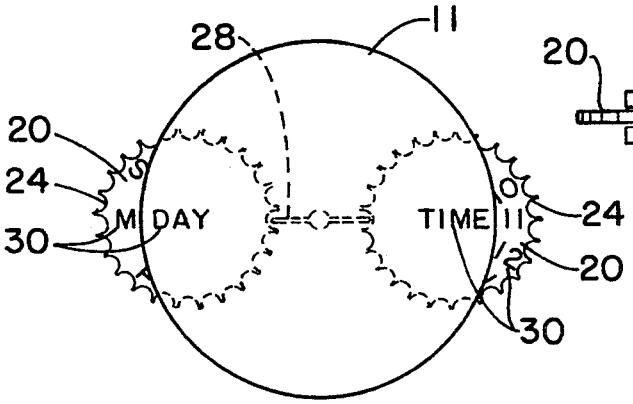
FIG. 3A is a plan view indicating the dials of the reminder device held in place by prongs.
Figure 3B:
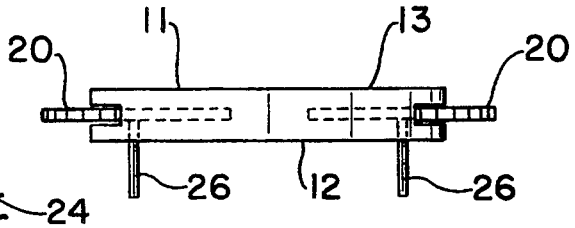
FIG. 3B is a side view of the reminder device with the dials held within the body shaped as a compressed cylinder or thin disk.
Figure 3C:
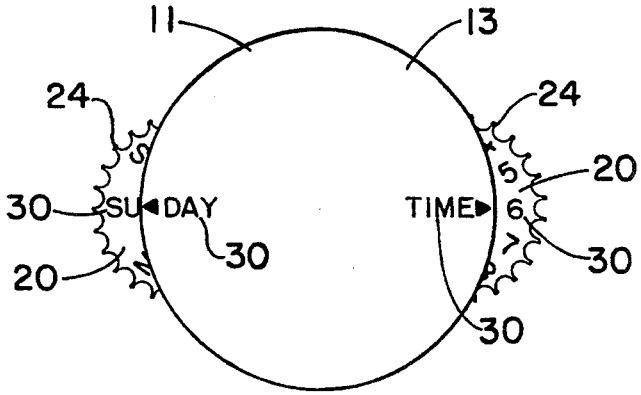
FIG. 3C is a top plan view of the reminder device attached thereto in operative array.

FIG. 3A demonstrates that the dials 20 may be retained in set position by prongs 28 which engage gear teeth 24 serving as splines for the prongs. As such, each dial 20 may be separately or independently reset to the next designated time for medication. Meanwhile, the side view of the reminder device shown in FIG. 3B, demonstrates the body 11 of reminder device 10 is formed to the shape of a compressed cylinder or thin disk. In FIG. 3C, a first embodiment of the reminder device having two dials 20 may extend beyond or outside the circumference of the circular base.

Figure 4A:
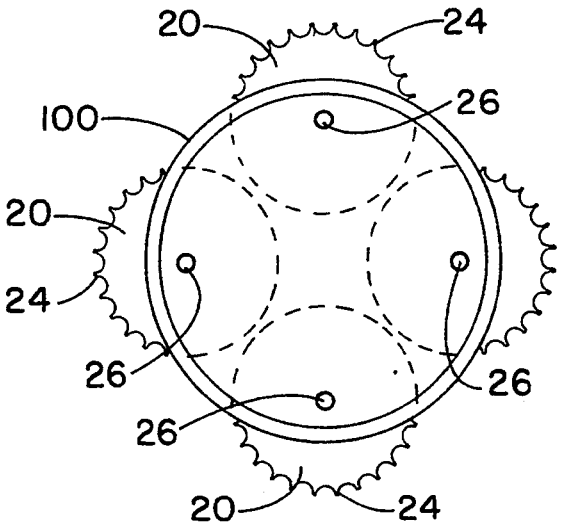
FIG. 4A is a view of the inside of a bottle cap indicating the pins holding the reminder device in place.
Figure 4B:
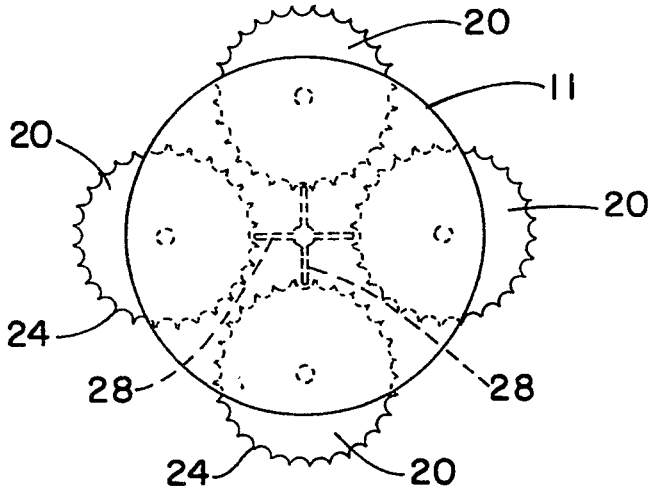
FIG. 4B is a top plan view of the reminder device.
Figure 4C:
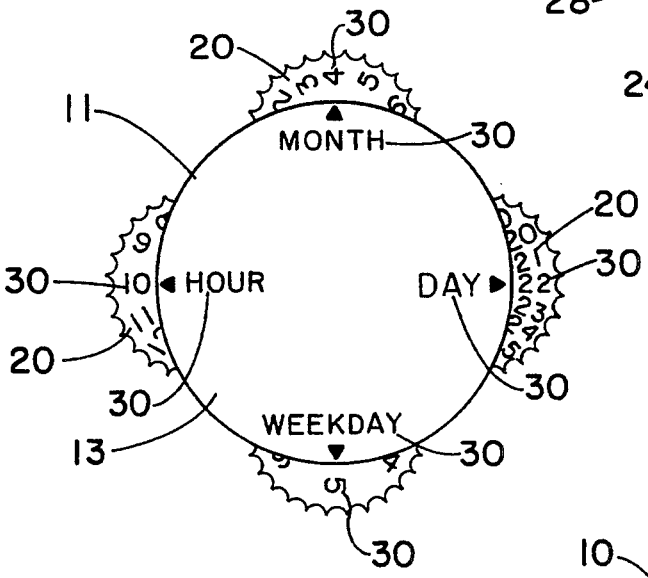
FIG. 4C is a top plan view of the reminder device with indicators for day, date, month and hour.
Figure 4D:
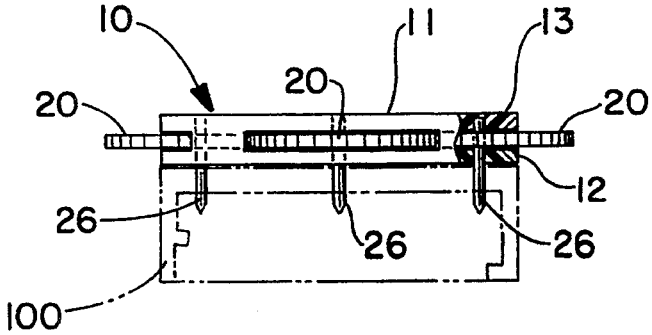
FIG. 4D is a side elevational view, with portions broken away, of the reminder device attached to a pill bottle cap.

Referring now to FIG. 4A, pins or spindles 26 for the dials 20 can be inserted in the bottle cap 100 for attachment of the reminder device 10. Reference to FIG. 4B indicates that the reminder device 10 may have four dials 20 whose perimeters 22 extend beyond the circumference 16 of the disk-shaped base 12 such that four prongs 28 are needed for setting each of the dials 20 as a reminder to the user of the reminder device 10. FIG. 4C shows the time indicators 30 directed toward dials 20 and the indicators 30 on the top portion of the body and on the dials may be colored for highlighting the month, weekday, date and hour or alternatively, may be printed, may be constructed by raised lettering and numbers or the indicators can be in braille for assistance to blind persons.

The terms and expressions which have been used herein are used as terms of description and not of limitation, and there is no intention in the use of such terms and expressions of excluding any equivalent of any of the features shown or described, or portions thereof, and it is recognized that various modifications are possible within the scope of the invention claimed.

What is claimed is:

1. A reminder device for pill dispensing containers, comprising:

a body having a base and top portion; said base having first and second surfaces, said first surface having at least one aperture therethrough to receive at least one spindle to project outwardly and essentially orthogonally from said first surface of the base into the top portion of said body; and said second surface having a means for securing the second surface to a surface of an object;

at least one dial rotatably mounted on said at least one spindle, each said at least one dial having a perimeter; said top portion of said body and each said at least one dial having indicia indicating time thereon, said indicia being discernible to a user; and, means for engaging the perimeter of said at least one dial mounted on said base to retain said at least one dial in a set position relative to said base.

2. The reminder device described in claim 1, wherein the base has a circular shape and a circumference.

3. The reminder device of claim 2, wherein said at least one dial has a circular shape and gear teeth are formed in said perimeter.

4. The reminder device of claim 3, said device having a plurality of dials wherein indicia on respective dials indicate days of a week, date, and time of day.

5. The reminder device of claim 4, wherein said means for engaging comprises prongs mounted on the first surface of said base, said prongs in ratcheting engagement with gear teeth on the perimeter of each dial.

6. The reminder device of claim 5, wherein said means for securing the second surface to an object comprises and adhesive.

7. The reminder device of claim 5, wherein said means for securing the second surface to an object is provided by said at least one spindle, and wherein said at least one spindle extends through the base and has a sharpened point to pierce a pill dispensing container top and to secure the reminder device to said top.

8. The reminder device of claim 6 or 7, wherein a point on the perimeter of said at least one dial corresponds with the circumference of said circular shape base and inwardly extending recessed areas are formed on the top portion of said body to allow visibility and contact with indicia on each said dial.

9. The reminder device of claim 6 or 7, wherein the perimeter of said at least one dial is within the circumference of said base with inwardly extending recessed areas formed on the top portion of said body.

10. The reminder device of claim 6 or 7 wherein the perimeter of said at least one dial extends beyond the circumference of said base.

11. The reminder device of claim 1, wherein said at least one dial is manually rotatable.

* * * * *